US005545978A

United States Patent [19]

Pontius

[11] Patent Number: 5,545,978

[45] Date of Patent: Aug. 13, 1996

[54] BANDGAP REFERENCE GENERATOR HAVING REGULATION AND KICK-START CIRCUITS

[75] Inventor: Dale E. Pontius, Colchester, Vt.

[73] Assignee: International Business Machines Corporation, Armonk, N.Y.

[21] Appl. No.: 266,281

[22] Filed: Jun. 27, 1994

[51] Int. Cl.[6] ..... G05F 3/16

[52] U.S. Cl. ..... 323/313

[58] Field of Search ..... 323/313

[56] References Cited

U.S. PATENT DOCUMENTS

| | | | |
|---|---|---|---|
| 4,085,359 | 4/1978 | Ahmed | 323/22 T |
| 4,176,308 | 11/1979 | Dobkin et al. | 323/4 |
| 4,443,753 | 4/1984 | McGlinchey | 323/313 |
| 4,931,718 | 6/1990 | Zitta | 323/313 |
| 5,144,223 | 9/1992 | Gillingham | 323/313 |
| 5,291,122 | 3/1994 | Audy | 323/313 |
| 5,367,249 | 11/1994 | Honnigford | 323/313 |

FOREIGN PATENT DOCUMENTS 0039178 4/1981 European Pat. Off. .

2071955 9/1981 United Kingdom .

*Primary Examiner*—Stuart N. Hecker

*Attorney, Agent, or Firm*—Heslin & Rothenberg, P.C.

[57] ABSTRACT

A bandgap reference generator providing a reference voltage $V_R$ from a power supply voltage $V_{DD}$. The bandgap reference generator includes a bandgap reference circuit and a voltage regulation circuit coupled thereto. The voltage regulation circuit operates to supply power to the bandgap reference circuit such that the voltages at a first internal control node and a second internal control node are equal, wherein the first internal control node and the second internal control node are disposed on different current paths within the bandgap reference circuit. By equalizing voltages at these internal control nodes, device stress within the bandgap reference circuit is reduced. Kick-start circuits for the voltage regulation circuit and the bandgap reference circuit are also included within the bandgap reference generator. In addition, output stage processing can be incorporated to transform an outputted reference voltage $V_R$ from a low stress operating point to a desired reference voltage $V_{REF}$.

33 Claims, 4 Drawing Sheets

BANDGAP REFERENCE GENERATOR HAVING REGULATION AND KICK-START CIRCUITS

TECHNICAL FIELD

The present invention applies in general to reference voltage supplies, and in particular, to a bandgap reference generator having a regulation circuit for establishing symmetrical stress on internal devices of the bandgap reference generator and to a "kick-start" circuit for quickly achieving power-up of the bandgap reference generator.

BACKGROUND ART

Bandgap voltage generators are generally used to create a voltage which is equal to the bandgap potential of silicon devices at 0° Kelvin. There are several basic techniques used to generate the bandgap voltage, which is approximately 1.2 volts. In one technique, equal currents are passed through two diodes of different size, while in another, different currents are passed through different, equal sized diodes. Both complementary metal-oxide semiconductor (CMOS) field-effect transistor (FET) based and bipolar transistor based bandgap reference generators are well documented in the available literature.

Unfortunately, traditional bandgap reference generators have certain inherent weaknesses. First, large amounts of DC gain are typically involved, rendering the generators highly sensitive to mismatches, particularly in critical voltage and current mirrors. Further, voltages applied to critical devices in the current mirror(s) are balanced at only one input voltage, and can be severely mismatched at normal operating voltage. This mismatch, in addition to disturbing base operating points, contributes to asymmetric stresses, thereby further aggravating sensitivity of the generator. Further, most CMOS field-effect transistor based bandgap reference generators are slow in start-up, resulting in minimal practical use, at least not without modification.

All of the above-noted weaknesses are addressed in a bandgap reference generator employing regulation and kick-start circuits embodying the concepts presented herein below.

DISCLOSURE OF INVENTION

Briefly summarized, this invention comprises in one aspect a bandgap reference generator for providing a reference voltage $V_R$ from a power supply voltage $V_{DD}$. The generator includes a bandgap reference circuit (BRC) and a voltage regulation circuit. The BRC has an input for receiving a supply power and an output for providing the reference voltage $V_R$. The BRC also has a first internal node and a second internal node having first and second voltages, respectively. The voltage regulation circuit is coupled to the BRC and connected to receive the power supply voltage $V_{DD}$. The voltage regulation circuit establishes the supply power at the input to the BRC such that the first voltage at the first internal node and the second voltage at the second internal node of the BRC tend to be maintained equal. By maintaining these voltages equal, asymmetric device stress within the bandgap reference circuit is reduced. In certain enhanced circuits presented herein, the voltage regulation circuit includes a transconductance operational amplifier, which establishes the supply power at the input to the bandgap reference circuit. Further, BRC kick-start and voltage regulation kick-start circuitry are presented.

In another aspect, a regulation circuit for a bandgap reference circuit (BRC) is disclosed. The BRC has an input for receiving supply power and an output for providing a reference voltage $V_R$. The bandgap reference circuit also has a first internal node with a first voltage and a second internal node with a second voltage. The regulation circuit includes regulating means for adjusting the supply power at the input to the bandgap reference circuit and means for coupling the regulating means to the first and second internal nodes of the BRC. The regulating means adjusts supply power at the input to the bandgap reference circuit such that the first voltage at the first internal node is maintained equal to the second voltage at the second internal node, thereby reducing asymmetric device stress within the bandgap reference circuit.

In yet another aspect, the present invention comprises a method for reducing asymmetric device stress within a bandgap reference circuit (BRC) having an input for receiving supply power and an output for providing a reference voltage $V_R$. The method comprises the steps of: providing the supply power to the input of the bandgap reference circuit; monitoring a first voltage at a first internal node of the bandgap reference circuit and a second voltage at a second internal node of the bandgap reference circuit; and modifying the supply power such that the first voltage equals the second voltage, thereby reducing asymmetric device stress within the bandgap reference circuit.

Those skilled in the art will note from the following discussion that a regulation circuit in accordance with the present invention minimizes asymmetric stress on device components within a standard bandgap reference circuit. The concept of equalizing voltages at certain critical nodes within such a circuit is applicable to most, if not all, bandgap reference circuit formations, including those implemented using bipolar transistor technology. Also presented are certain novel kick-start circuits for insuring quick power-up of the bandgap reference generator. These kick-start circuits remove themselves from operation once the generator reaches operating equilibrium. An output stage may be employed to develop a desired reference voltage from an ideal operating point reference voltage $V_R$ determined by circuit elements.

BRIEF DESCRIPTION OF DRAWINGS

These and other objects, advantages and features of the present invention will be more readily understood from the following detailed description of certain preferred embodiments of the invention, when considered in conjunction with the accompanying drawings in which.

BEST MODE FOR CARRYING OUT THE INVENTION

Reference is now made to the drawings in which use of the same reference numbers/characters throughout different figures designate the same or similar components.

Figure 1:
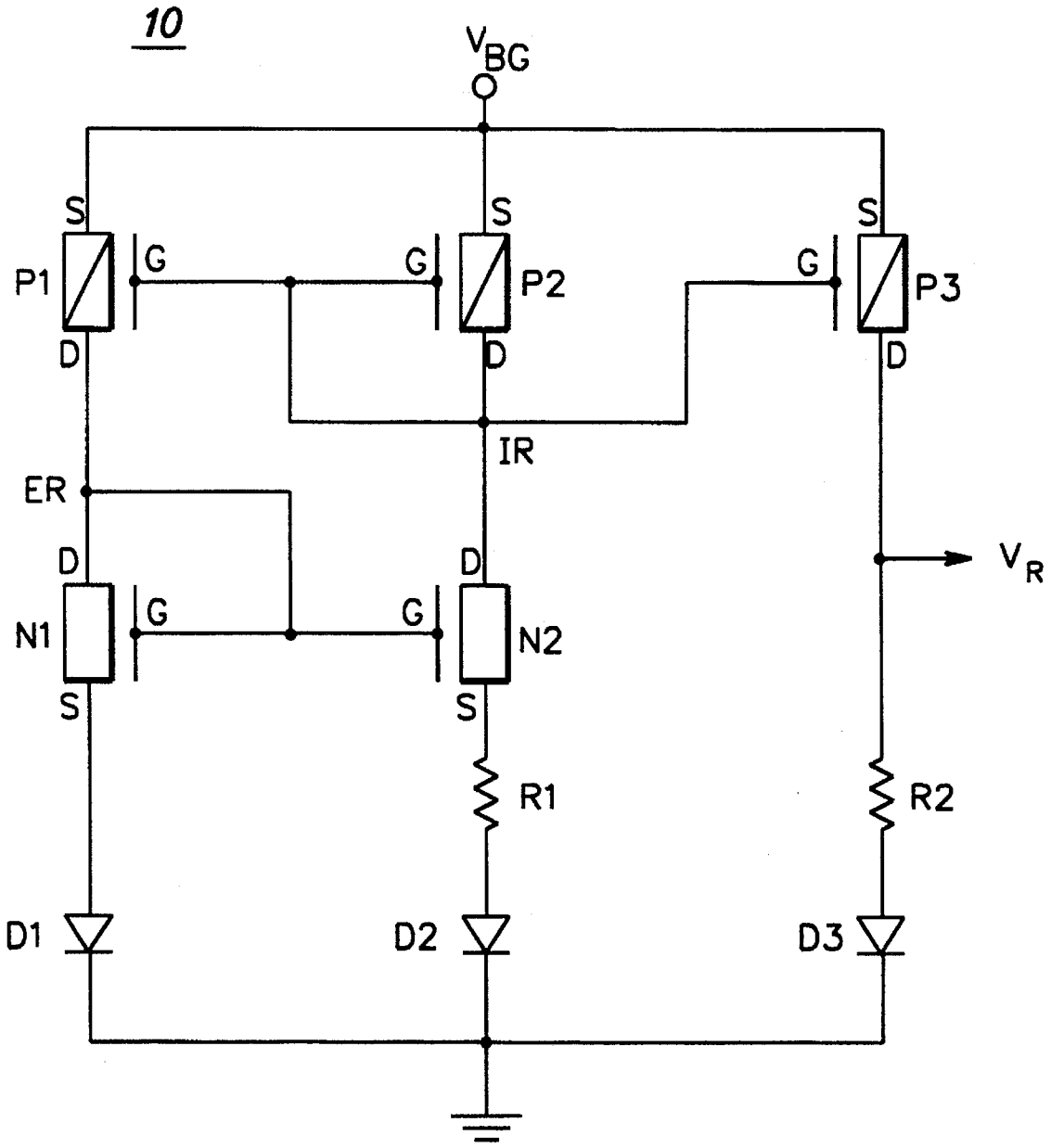
fig. 1 (PRIOR ART)
FIG. 1 is a schematic diagram of one embodiment of a standard bandgap reference circuit (BRC)

One embodiment of a standard bandgap reference circuit (BRC), generally denoted 10, is depicted in FIG. 1. In the figures, complementary metal-oxide semiconductor (CMOS) circuits with P-channel field-effect transistors (PFETs) are indicated by a rectangle with a diagonal line formed therein and a control element or gate electrode arranged adjacent thereto and N-channel field-effect transistors (NFETs) are depicted as a rectangle without a diagonal line and with a control element or gate electrode arranged adjacent thereto.

BRC 10 includes three current paths between a supply voltage, designated $V_{BG}$, and ground potential. Conventionally, the supply voltage to a bandgap reference circuit comprises an available power supply voltage ($V_{DD}$). A first current path in BRC 10 is through PFET P1, which has its source (S) tied to supply voltage $V_{BG}$ and its drain (D) connected to the drain (D) of an NFET N1. The commonly connected drains define a first internal node "ER". The drain (D) and gate (G) of NFET N1 are connected together such that node "ER" comprises a control node within BRC 10. The source (S) of NFET N1 is coupled to ground potential across a first diode D1.

The gate (G) of PFET P1 is tied to the gate (G) of a second PFET P2, which partially defines a second current path between supply voltage $V_{BG}$ and ground potential. PFET P2 has its source (S) tied to the supply voltage $V_{BG}$ and its gate (G) and drain (D) commonly connected to the drain (D) of a second NFET N2. Device N2 has its control gate (G) tied to the gate (G) of NFET N1 and its source (S) coupled to ground across a first resistor R1 and a second diode D2. By way of example, diode D2 is ratioed ten times (10×) larger than diode D1. The commonly connected gates (G) of PFETs P1 & P2 comprise a second control node "IR".

A third current path of BRC 10 is through a PFET P3 that has its source (S) tied to supply voltage $V_{BG}$, its gate (G) connected to node "IR" and its drain (D) coupled to ground across a second resistor R2 and a third diode D3. Reference voltage $V_R$ is provided at an output of bandgap reference circuit 10, which as shown, comprises the drain (D) of PFET P3. Diode D3 is ratioed similar to diode D1 and provides temperature compensation of the output reference voltage $V_R$, while the ratioing difference between diodes D1 & D2 drives the bandgap reference circuit. As is well known, to a first order approximation all characteristics of the transistors in the bandgap reference circuit drop out when determining reference voltage $V_R$.

Typically, the field-effect transistors of the classical bandgap reference circuit 10 of FIG. 1 see radically different operating points. Transistors N1 and P2 have approximately one threshold voltage $V_t$ drop from drain (D) to source (S), while transistors N2 and P1 experience the supply voltage $V_{BG}$ minus a threshold voltage $V_t$ plus a voltage equal to the voltage drop across a diode. The output transistor P3 has something in between. Clearly, there is asymmetric device stress with such a bandgap reference circuit, meaning that the devices will age differently. Further, as a result of the different operating voltages, BRC 10 will be somewhat imbalanced due to drain modulation. Thus, reference voltage $V_R$ output with respect to the supply voltage $V_{BG}$ can vary.

Conceptually, the present invention comprises "de-stressing" the internal devices of BRC 10. This is accomplished by equalizing the voltages at control nodes "ER" and "IR". Node "ER" comprises the control node for the source-follower coupled NFETs N1 & N2, while node "IR" comprises the control node for the current mirror encompassing PFETs P1 & P2. By establishing an operating point with node "ER" equal to node "IR" an "equal stress" voltage is obtained within the bandgap reference circuit. Further, by selecting a corresponding output voltage $V_R$, the stress on output device P3 can be made equal to the stress on the other devices of BRC 10. In addition to equalizing stress voltages, the effects of drain modulation are simultaneously minimized or cancelled.

Figure 2:
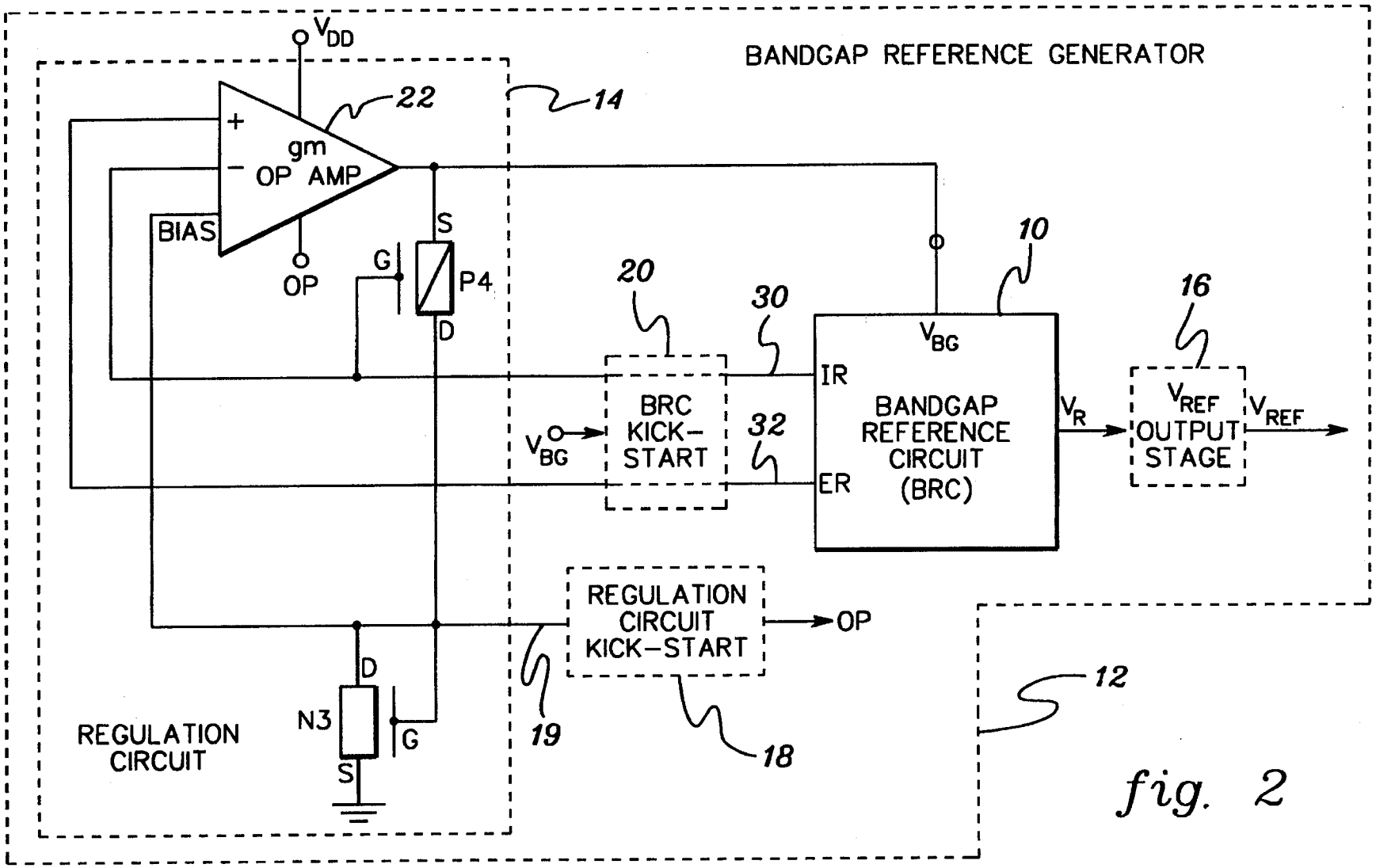
FIG. 2 is a schematic diagram of one embodiment of a bandgap reference generator implemented in accordance with the present invention.

One embodiment of a bandgap reference generator, generally denoted 12, in accordance with the present invention is shown in FIG. 2. Generator 12 includes standard bandgap reference circuit (BRC) 10 and a regulation circuit 14 coupled thereto. Circuit 14 maintains equivalent operating voltages at nodes "ER" & "IR". This is accomplished by tying nodes "ER" & "IR" via lines 30 & 32, respectively, to the two inputs of a transconductance operational amplifier (gm OP AMP) 22 within regulation circuit 14. The output of gm OP AMP 22 is coupled to the input of BRC 10 for supply voltage $V_{BG}$. Gm OP AMP 22 is fed by power supply $V_{DD}$ and, preferably, receives a "BIAS" signal and an "OP" signal from power-up kick-start circuitry discussed below.

When the voltages at nodes "ER" & "IR" drift apart, gm OP AMP 22 operates to vary current supplied to the input of BRC 10 (and thus supplied power) so as to re-establish equal voltages at the two nodes. For example, if the voltage at node "IR" drifts to a value greater than the voltage at node "ER", then gm OP AMP 22 works to lower the supply power at the input to BRC 10 until the voltage at node "IR" becomes equal to that at node "ER". Alternatively, if the voltage at node "IR" drifts to a value less than the voltage at node "ER", then gm OP AMP 22 seeks to raise supplied power to BRC 10 until the two internal node voltages are equal. Thus, the goal of gm OP AMP 22 is to place a "virtual short" between nodes "ER" & "IR" of BRC 10. Because gm OP AMP 22 is a transconductance configured operational amplifier, its output comprises a current value. Amplifier 22 is designed such that when the voltages at nodes "ER" & "IR" are equal, the necessary current for correct operation of BRC 10 will be supplied. Thus, the operational amplifier corrects irregularities. One embodiment of transconductance operational amplifier 22 is discussed below with reference to FIG. 6.

The bias current "BIAS" for the operational amplifier is derived from the operating point of BRC 10 by current mirror devices PFET P4 and NFET N3. As shown, PFET P4 is gated (G) by the signal at node "IR" and is connected at its source (S) to the output of gm OP AMP 22. NFET N3 has its gate (G) tied to the commonly coupled drains (D) of devices P4 and N3, and its source (S) connected to ground. This current mirror insures that the current in gm OP AMP 22 is locked to the current in BRC 10.

Again, FIG. 2 comprises just one embodiment of a regulation circuit for equalizing the voltages at two critical control nodes of the bandgap reference circuit. Other circuits which accomplish the same objective are also possible. Further, the presented regulation concept can be employed in other types of standard bandgap reference circuits.

As mentioned briefly above, additional internal "de-stressing" is obtained if transistor P3 provides a reference voltage $V_R$ approximately equal to the voltage on nodes "ER" & "IR". Because the output voltage is determined by circuit elements, additional effort may be required to attain a desired reference voltage $V_{REF}$. This is the function of $V_{REF}$ output stage 16 shown in phantom in FIG. 2. For example, if a lower voltage is desired, then stage 16 can comprise a tap point located on output resistor R2 (FIG. 1) of bandgap reference circuit 10. Alternatively, if a higher voltage is required, then $V_{REF}$ output stage 16 could comprise a buffer amplifier such as shown in FIG. 3.

Figure 3:
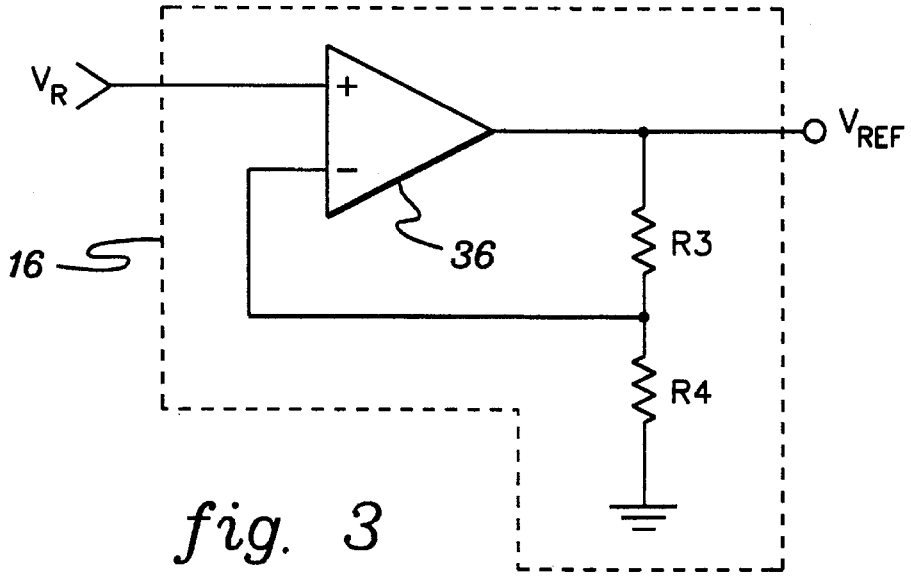
FIG. 3 is a schematic diagram of one embodiment of a $V_{REF}$ output stage circuit in accordance with the present invention for the bandgap reference generator of FIG. 2.

The output boosting network of FIG. 3 includes a two input operational amplifier 36 which receives, at a first input, the reference signal $V_R$ from BRC 10 and, at a second input, feedback from its output. The output of operational amplifier 36 comprises the desired reference voltage signal $V_{REF}$. Output feedback is from the common connection of two resistors R3 & R4 across which the desired reference voltage signal $V_{REF}$ appears.

A further characteristic of bandgap reference generator 12 of FIG. 2 is the inclusion of certain novel kick-start circuitry for quickly powering up the bandgap reference generator. In classical bandgap reference circuits, a "pseudo-stable" operating point exists when all transistors are "off". This is because the natural couplings of PFETs P1, P2 & P3 and NFETs N1 & N2 (FIG. 1) are such that the voltage at node "IR" can go very high subsequent to power-up of the bandgap reference circuit 10, virtually following supply voltage $V_{BG}$, while the voltage at node "ER" stays close to ground. Thus, the goal of the kick-start is to lower the voltage at node "IR" sufficiently to turn on PFETs P1, P2 & P3 while getting the voltage at node "ER" high enough to turn on NFETs N1 & N2. Once the bandgap reference circuit is "kicked" away from its pseudo-stable zero volt operating locus, then the circuit rapidly moves to the desired operating locus. Thus, "kick-start" circuitry is employed to hasten the power-up process to meet today's fast power-up requirements.

Figure 4:
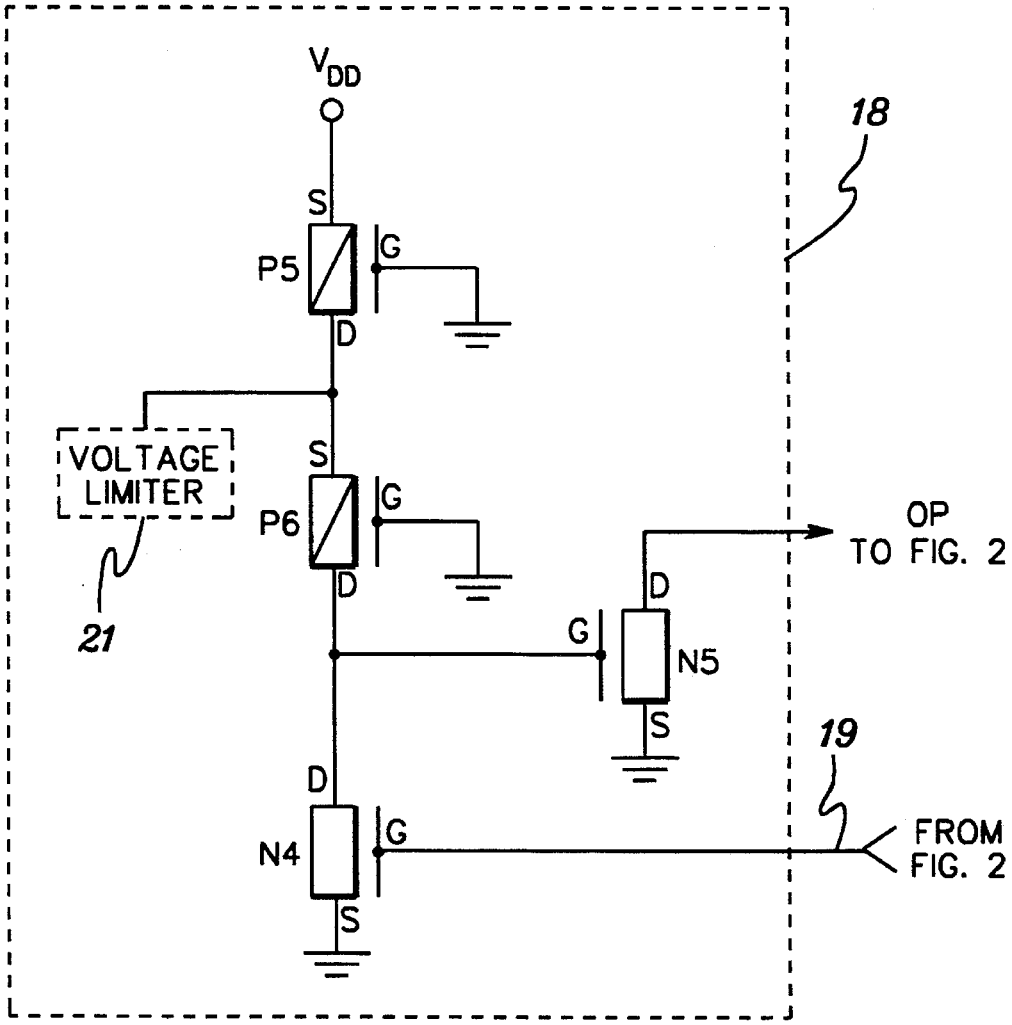
FIG. 4 is a schematic diagram of one embodiment of a "regulation circuit kick-start" in accordance with the present invention for the bandgap reference generator of FIG. 2.

In the generator embodiment of FIG. 2, regulation circuit kick-start 18 and BRC kick-start 20 cooperate to rapidly power-up bandgap reference generator 12 (FIG. 2). One embodiment of regulation circuit kick-start 18 is presented in FIG. 4. In this embodiment, the signal on the commonly coupled node 19 of the current mirror comprising devices P4 and N3 (FIG. 2) is fed to the gate (G) of an NFET N4 that has its source (S) connected to ground. The drain (D) of device N4 is connected to the drain (D) of a PFET P6 and the gate (G) of another NFET N5. The signal on the drain (D) of device N5 comprises signal "OP" which as noted above, is sent to operational amplifier 22 (FIG. 2). Its source (S) is tied to ground potential. Power is received from power supply $V_{DD}$ across a PFET P5, which has its gate (G) tied to ground. The drain (D) of PFET P5 is connected to the source (S) of PFET P6, which also has its gate (G) grounded.

Operationally, as bandgap reference generator 12 is powered up, PFETs P5 & P6 begin to pull the commonly coupled drain node between PFET P6 and NFET N4 high, turning NFET N5 "on". This in turn pulls node "OP" down, turning a PFET P7 (FIG. 6, discussed below) within the operational amplifier "on", which then begins to power-up regulation circuit 14 (FIG. 2), thus completing kick-start.

If desired, a voltage limiter 21 (shown in phantom) can be connected to the drain-to-source connection of PFETs P5 & P6. This may be needed because regulation circuit kick-start 18 should have no effect on the bandgap reference generator once powered up and stabilized. However, if supply voltage $V_{DD}$ is too high, trickle current through PFETs P5 & P6 may possibly overcome NFET N4, in which case operation of the bandgap reference circuit 10 (FIG. 2) would be upset. Voltage limiter 21 thus acts to clip the voltage so that the current in PFET P6 remains sufficiently low. At low voltages, the kick-start circuitry will have no effect on bandgap reference generator operation.

Figure 5:
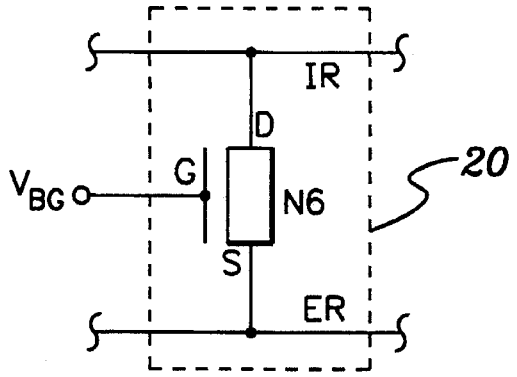
FIG. 5 is a schematic diagram of one embodiment of a "BRC kick-start" in accordance with the present invention for the bandgap reference generator of FIG. 2.

One embodiment of BRC kick-start 20 is depicted in FIG. 5. As shown, this kick-start circuit comprises an NFET N6 connected between nodes "ER" & "IR" of the bandgap reference circuit. Specifically, the drain (D) of NFET N6 is tied to node "IR", while the source (S) of the transistor is tied to node "ER". Transistor N6 is controlled by the supply voltage $V_{BG}$ received by the bandgap reference circuit 10 (FIG. 2). Operationally, when supply voltage $V_{BG}$ rises, node "IR" is capacitively coupled to the voltage and rises as well, leaving PFETs P1, P2 and P3 "off" while node "ER" remains near ground, leaving nodes N1 & N2 "off". The situation is semi-stable, however, in that only accidental leakage will move BRC 10 (FIG. 2) from this state. When supply voltage $V_{BG}$ rises above the voltage at node "ER", device N6 turns "on", pulling the voltage at node "IR" down and the voltage at node "ER" up. This has the combined effect of turning "on" NFETs N1 & N2 and PFETs P1, P2 & P3. When BRC 10 reaches final equilibrium, nodes "IR" and "ER" will be at a "virtual short" so NFET N6 will not conduct current nor imbalance the bandgap reference circuit. Further, because transistor N6 is an NFET in the substrate, its threshold voltage $V_T$ rises due to the body effect. Thus, the device also tends to turn "off" for this reason.

Figure 6:
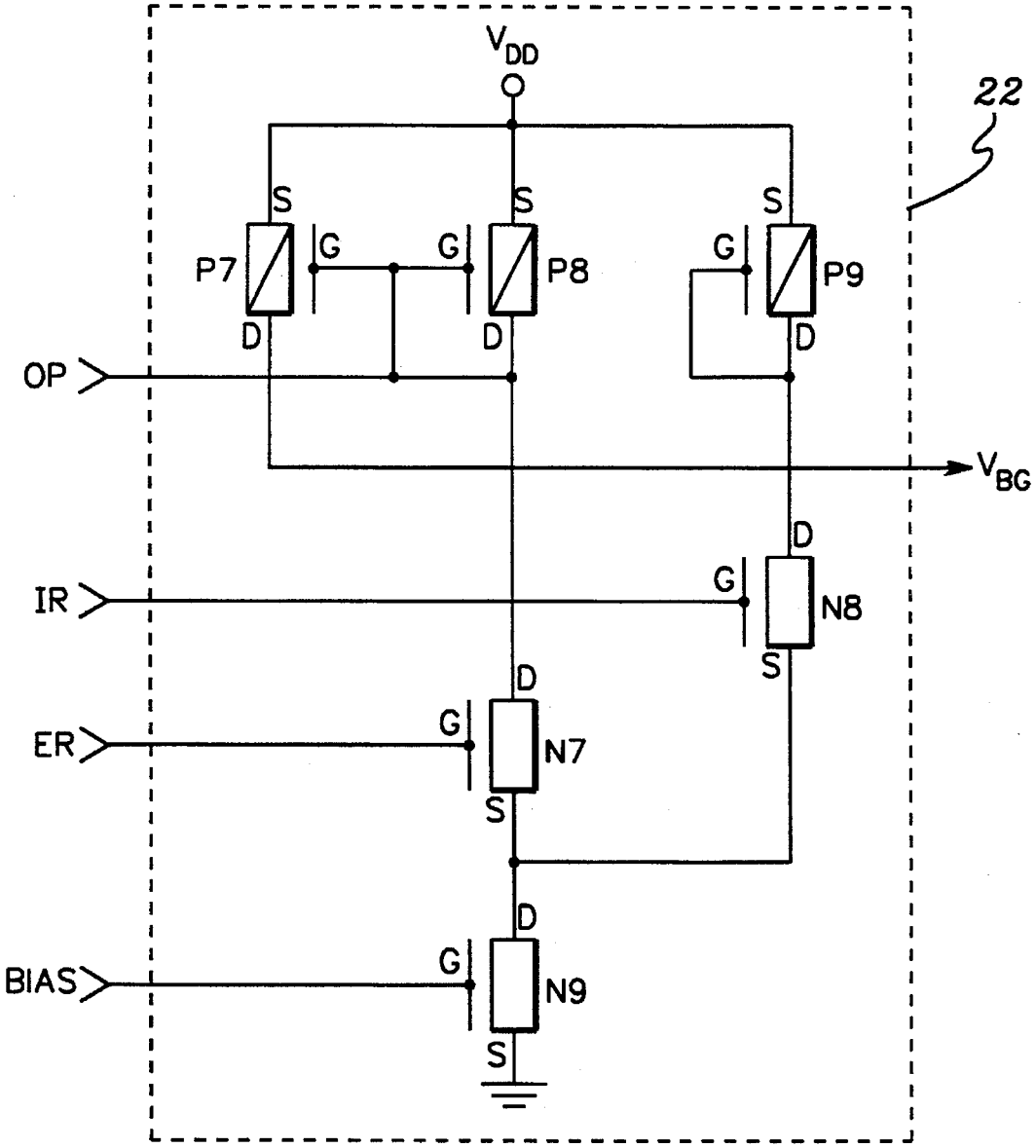
FIG. 6 is a schematic diagram of one embodiment of a transconductance operational amplifier in accordance with the present invention for the regulation circuit of the bandgap reference generator of FIG. 2.

Referring next to FIG. 6, one embodiment of a transconductance operational amplifier 22 in accordance with the present invention is next described. Transconductance amplifier 22 comprises a voltage-controlled current source which receives as input power supply voltage $V_{DD}$, and the voltages at nodes "OP", "ER", "IR", and "BIAS." The outputted current is provided to the supply power input of BRC 10 (FIG. 2). The controlling voltages are the voltages at nodes "ER" & "IR".

More particularly, voltage $V_{DD}$ is provided to the source (S) of PFETs P7, P8 & P9 as shown. PFETs P7 & P8 are commonly gated (G) by the voltage at node "OP". This node signal is also tied to the drain (D) of PFET P8. The drain of PFET P7 provides current to supply voltage $V_{BG}$ input of BRC 10 (FIG. 2). PFET P9 has its gate (G) tied to its drain (D), which is also connected to the drain (D) of an NFET N8. NFET N8 is gated (G) by the signal at node "IR" and has a source (S) tied to the common node of an NFET N7 and NFET N9. This node is defined by the connection of the source (S) of NFET N7 to the drain (D) of NFET N9. Completing the circuit, the drain (D) of NFET N7 is connected to the drain (D) of PFET P8, while the source (S) of NFET N9 is tied to ground. Transistor N7 is gated (G) by the voltage at node "ER" and transistor N9 is gated (G) by the BIAS signal from the current mirror comprising devices P4 & N3 (FIG. 2).

Note that at the designed operating point, all transistor devices will have identical operating points in a device—parameter independent fashion, with the exception of PFET P3 of BRC 10 (FIG. 1). By choosing a value for reference voltage $V_R$ approximately equal to that of the voltage on nodes "ER" & "IR" the operating condition of PFET P3 can be fairly well balanced to that of PFETs P1 & P2. In such a case, the value of reference voltage $V_R$ would necessarily be specifically chosen, thus the potential need for output stage 16 to obtain a desired reference voltage $V_{REF}$.

Those skilled in the art will note from the above discussion that the regulation circuitry provided herein produces a "de-stressing" of the device components within the standard bandgap reference circuit. Further, "equalizing" voltages at critical nodes within the circuit is applicable to multiple bandgap reference circuit designs, including bipolar transistor based designs. Also provided are certain novel kick-start circuits for ensuring quick power-up of the bandgap reference generator. The kick-start circuits remove themselves from operation once the generator becomes active. Additionally, an output stage may be employed to develop a desired reference voltage from the ideal operating point determined by circuit elements.

While the invention has been described in detail herein in accordance with certain preferred embodiments thereof, many modifications and changes therein may be effected by those skilled in the art. Accordingly, it is intended by the appended claims to cover all such modifications and changes as fall within the true spirit and scope of the invention.

I claim:

1. A bandgap reference generator for providing a reference voltage $V_R$ from a supply voltage $V_{DD}$, said bandgap reference generator comprising:

a bandgap reference circuit (BRC) having an input for receiving supplied power and an output for providing said reference voltage $V_R$, said bandgap reference circuit also having a first internal node with a first voltage and a second internal node with a second voltage; and a voltage regulation circuit coupled to the bandgap reference circuit and connected to receive said supply voltage $V_{DD}$, said voltage regulation circuit establishing said supplied power at the input to said bandgap reference circuit such that the first voltage at the first internal node of the BRC and the second voltage at the second internal node of the BRC are maintained equal, wherein maintaining the first voltage equal to the second voltage reduces device stress within the bandgap reference circuit.

2. The bandgap reference generator of claim 1, wherein said voltage regulation circuit is coupled to said first internal node of the BRC and to said second internal node of the BRC.

3. The bandgap reference generator of claim 2, wherein the bandgap reference circuit includes multiple transistors, and wherein said first internal node comprises a first control node for at least one transistor of said multiple transistors and said second internal node comprises a second control node for a different at least one transistor of said multiple transistors.

4. The bandgap reference generator of claim 2, wherein said bandgap reference circuit includes a current mirror and a voltage mirror, and wherein said first internal node comprises a control node for said current mirror and said second internal node comprises a control node for said voltage mirror.

5. The bandgap reference generator of claim 4, wherein said current mirror includes two P-channel field-effect transistors (PFETs) and said voltage mirror includes two N-channel field-effect transistors (NFETs), and wherein said two PFETs have gate controls tied together at said first internal node and said two NFETs have gate controls tied together at said second internal node.

6. The bandgap reference generator of claim 1, wherein said bandgap reference circuit includes multiple current paths, and wherein said first internal node is disposed on a first current path of said multiple current paths and said second internal node is disposed on a second current path of said multiple current paths.

7. The bandgap reference generator of claim 6, wherein said multiple current paths comprise three current paths and said voltage regulation circuit's maintaining of the first voltage equal to the second voltage reduces stress on devices in the first current path and reduces stress on devices in the second current path, and wherein said bandgap reference generator further comprises means for reducing stress on devices in a third current path of the three current paths.

8. The bandgap reference generator of claim 7, wherein said means for reducing stress on devices in the third current path comprises means for operating said bandgap reference circuit such that the reference voltage $V_R$ at the output of the BRC is substantially equal to the first voltage and the second voltage maintained equal by the voltage regulation circuit.

9. The bandgap reference generator of claim 8, further comprising an output stage coupled to the output of said bandgap reference circuit for adjusting said reference voltage $V_R$ at the output of the BRC to a predefined voltage level $V_{REF}$, while said reference voltage $V_R$ is maintained equal to said first voltage and said second voltage.

10. The bandgap reference generator of claim 1, wherein said voltage regulation circuit includes an operational amplifier having an output coupled to the input of said bandgap reference circuit for providing the BRC with said supplied power.

11. The bandgap reference generator of claim 10, wherein the operational amplifier has a first input coupled to the first internal node of the bandgap reference circuit and a second input coupled to the second internal node of the bandgap reference circuit.

12. The bandgap reference generator of claim 11, wherein the operational amplifier comprises a transconductance operational amplifier.

13. The bandgap reference generator of claim 11, wherein the voltage regulation circuit further comprises means for biasing the operational amplifier with a current proportional to a current flowing within the bandgap reference circuit.

14. The bandgap reference generator of claim 13, wherein the means for biasing includes a current mirror for mirroring the current flowing within the bandgap reference circuit to the operational amplifier.

15. The bandgap reference generator of claim 1, further comprising means for kick-starting the bandgap reference circuit and the voltage regulation circuit upon commencing power-up of the bandgap reference generator.

16. The bandgap reference generator of claim 15, wherein said means for kick-starting comprises a BRC kick-start circuit and a voltage regulation kick-start circuit.

17. The bandgap reference generator of claim 16, wherein said voltage regulation kick-start circuit kick-starts the voltage regulation circuit and then the BRC kick-start circuit kick-starts the bandgap reference circuit upon commencing power-up of the bandgap reference generator.

18. The bandgap reference generator of claim 17, wherein the voltage regulation circuit includes an operational amplifier and said voltage regulation kick-start circuit includes means for initially kick-starting the operational amplifier upon power-up of the bandgap reference generator.

19. The bandgap reference generator of claim 17, wherein the BRC kick-start circuit is coupled to the first internal node and the second internal node of the bandgap reference circuit.

20. The bandgap reference generator of claim 16, wherein said voltage regulation kick-start circuit and said BRC kick-start circuit each include means for self-deactivating once said bandgap reference generator has reached an operating equilibrium.

21. A regulation circuit for a bandgap reference circuit (BRC) having an input for receiving a supply power and an output for providing a reference voltage $V_R$, the bandgap reference circuit also having a first internal node with a first voltage and a second internal-node with a second voltage, said regulation circuit comprising:

regulating means for adjusting the supply power at the input to the bandgap reference circuit;

means for coupling the regulating means to the first internal node of the bandgap reference circuit and to the second internal node of the bandgap reference circuit; and wherein said regulating means adjusts supply power at the input of the bandgap reference circuit such that the first voltage at the first internal node of the BRC is maintained equal to the second voltage at the second internal node of the BRC.

22. The regulation circuit of claim 21, wherein the bandgap reference circuit includes multiple transistors and said first internal node comprises a first control node for at least one transistor of said multiple transistors and said second internal node comprises a second control node for at least one transistor of said multiple transistors, said first control node and said second control node comprising different nodes within the bandgap reference circuit.

23. The regulation circuit of claim 21, wherein the bandgap reference circuit includes multiple current paths and said first internal node is disposed on a first current path of said multiple current paths and said second internal node is disposed on a second current path of said multiple current paths.

24. The regulation circuit of claim 21, wherein said regulating means includes an operational amplifier having an output coupled to the input of the bandgap reference circuit, said operational amplifier providing the BRC with said supply power.

25. The regulation circuit of claim 24, wherein the operational amplifier has a first input coupled to the first internal node of the bandgap reference circuit and a second input coupled to the second internal node of the bandgap reference circuit.

26. The regulation circuit of claim 24, wherein the operational amplifier comprises a transconductance operational amplifier.

27. The regulation circuit of claim 26, wherein the regulating means includes means for biasing the operational amplifier with a current proportional to a current flowing within the bandgap reference circuit.

28. The regulation circuit of claim 21, further comprising means for kick-starting the bandgap reference circuit and the regulating means upon commencing power-up of the bandgap reference circuit.

29. A method for reducing device stress within a bandgap reference circuit (BRC) having an input for receiving supply power and an output for providing a reference voltage $V_R$, said method comprising the steps of:

(a) providing said supply power to the input of the bandgap reference circuit;

(b) monitoring a first voltage at a first internal node of the bandgap reference circuit and a second voltage at a second internal node of the bandgap reference circuit; and (c) modifying the supply power such that the first voltage at the first internal node of the BRC equals the second voltage at the second internal node of the BRC, thereby reducing device stress within the bandgap reference circuit.

30. The method of claim 29, wherein said modifying step (c) includes adjusting current of the supply power at the input to the bandgap reference circuit such that the first voltage and the second voltage are equal.

31. The method of claim 29, further comprising the step of operating the bandgap reference circuit such that the reference voltage $V_R$ at the output is substantially equal to the first voltage and to the second voltage of the bandgap reference circuit.

32. The method of claim 31, further comprising the step of modifying the reference voltage $V_R$ output from the bandgap reference circuit to a desired voltage level $V_{REF}$.

33. The method of claim of 29, further comprising the step of kick-starting the BRC upon commencing power-up of the bandgap reference circuit.

* * * * *